US005176297A

United States Patent [19]

Mooney et al.

[11] Patent Number: 5,176,297

[45] Date of Patent: Jan. 5, 1993

[54] DISHWASHER DETERGENT DISPENSER

[75] Inventors: Phillip B. Mooney, Burlington; Michael W. Hetherington, Mount Albert, both of Canada

[73] Assignee: Diversey Corporation, Ontario, Canada

[21] Appl. No.: 537,567

[22] Filed: Jun. 14, 1990

[51] Int. Cl.[5] ..... G01F 11/00

[52] U.S. Cl. ..... 222/325; 222/361; 222/365

[58] Field of Search ..... 222/365, 651, 652, 325, 222/518, 361, 362, 332; 134/99, 100; 68/17 R

[56] References Cited

U.S. PATENT DOCUMENTS

| | | | |
|---|---|---|---|
| 1,233,791 | 7/1917 | Kaiser | 222/361 |
| 1,974,789 | 9/1934 | Angell | 222/365 |
| 2,245,265 | 6/1941 | Eddy | 222/365 |
| 2,254,269 | 9/1941 | Clark et al. | 222/651 X |
| 3,370,597 | 2/1968 | Fox | 222/651 X |
| 3,389,834 | 6/1968 | Collins | 222/365 |
| 4,394,941 | 7/1983 | Recine | 222/361 X |
| 4,440,322 | 4/1984 | Henry | 222/361 X |
| 4,917,272 | 4/1990 | Ikeda | 222/236 X |

*Primary Examiner*—Donald T. Hajec
*Assistant Examiner*—Anthoula Pomrening
*Attorney, Agent, or Firm*—Weintraub, DuRoss & Brady

[57] ABSTRACT

A dispensing system adapted for dispensing a dose of a liquid dishwasher chemical agent inside a dishwasher when the dispensing system is mounted inside a dishwasher includes:

i) a detergent dispensing system mounted inside the dishwasher;

ii) a container for a dishwasher detergent liquid;

iii) a dispensing device for dispensing from the container a dose of a dishwasher liquid to inside a dishwasher; and iv) the container being removable from the dispensing device to permit replacement of the container as required.

29 Claims, 6 Drawing Sheets

FIG.10
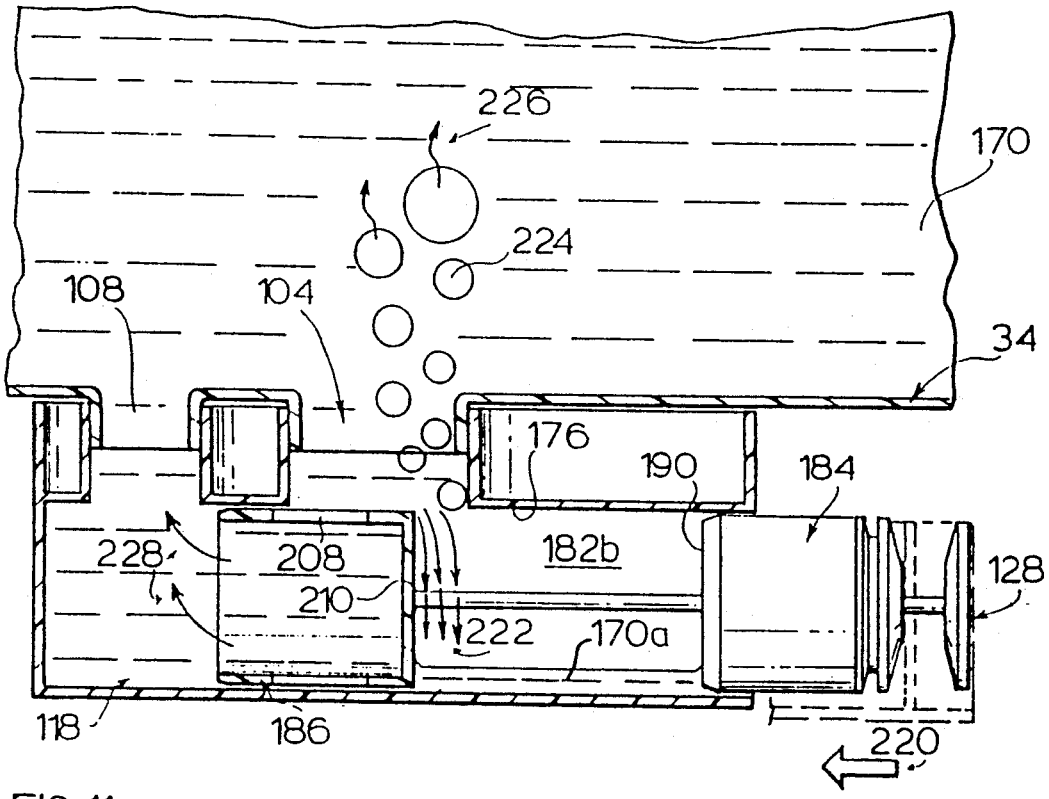
FIG.11
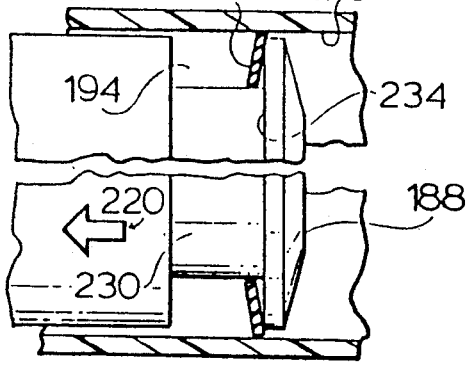
FIG.12
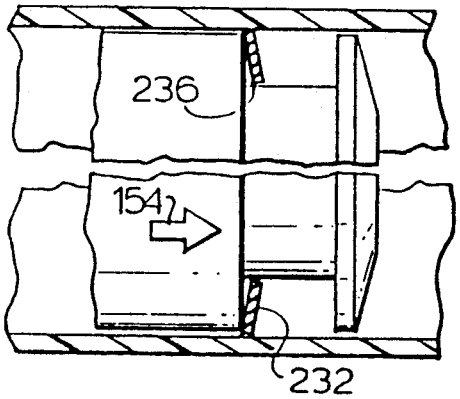
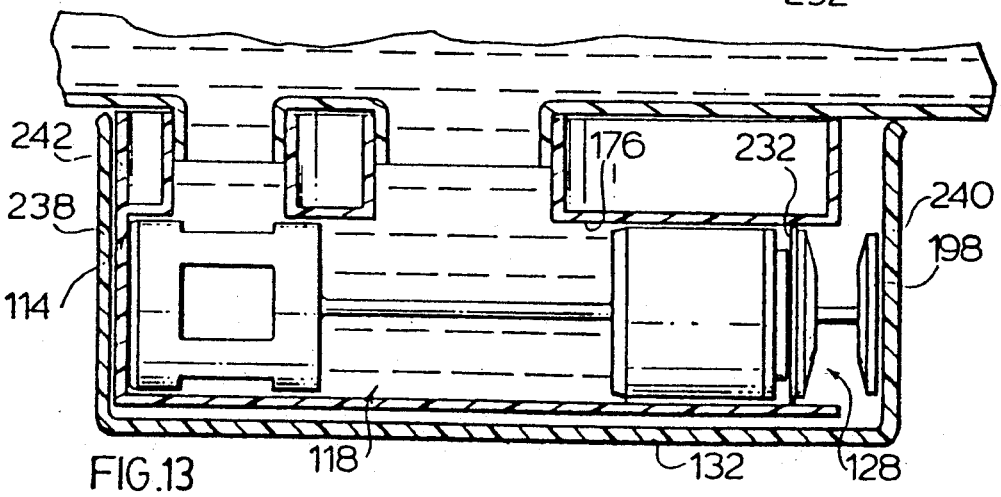
FIG.13

DISHWASHER DETERGENT DISPENSER

FIELD OF THE INVENTION

This invention relates to a dispensing device which is mountable on the inside of a dishwasher and which dispenses from a removable container a desired dose of dishwashing detergent liquid in the dishwasher.

BACKGROUND OF THE INVENTION

It is generally recognized that superior cleaning of tableware which includes dishes, flatware, glasses, cups, mugs and the like are more reliably or consistently cleaned and sanitized by dishwasher machines than can be accomplished by hand. The principle reasons for this advantage that dishwasher machines have over hand washing is in the use of stronger detergents and considerably higher wash water temperatures at least during the wash and rinse cycles. In the industrial environment, the significant labor cost in any establishment requiring the cleaning of tableware places increased demand on the use of dishwasher machines. There is also considerable use of such machines in most households in view of the better cleaning performance of dishwasher and also because less time is spent in cleaning the tableware.

Institutional dishwashing machines are operated under very demanding conditions. The machines normally operate with a one to two minute cycle during which the dishes are washed and rinsed and ready for reuse. Highly caustic dishwasher detergents are used to obtain meaningful cleaning within that time. In addition, it is also necessary to use various rinse aids during the rinse cycle in order to reduce spotting on the glassware. In the larger institutional dishwashers, electronically controlled pumps may be used for dispensing, from outside the dishwasher through conduits to inside the dishwasher, the necessary quantities of dishwasher detergent and rinse aids. Such electronically controlled dispenser systems are fairly expensive and can only be used in an economical manner on larger institutional dishwasher equipment. Although they work very well in this environment they do require periodic service and attention to ensure that the correct amount of dishwasher detergent, whether it be in liquid or slurried form, and rinse aid are properly dispensed within the dishwasher. By virtue of the dispenser being outside the machine, the dishwasher has to be provided with conduits which extends through the dishwasher tub to permit dispensing of the desired chemicals to within the machine. As a result in accordance with some regulatory laws, various types of fittings are required in the line to prevent mixing of wash liquids with fresh chemicals, solutions, detergents and rinse aids to be introduced to the machine. All of this adds to the complexity, cost and periodic servicing required. However, in view of the large volume of tableware handled by institutional machines, these costs are relatively negligible compared to the overall effectiveness in washing large volumes of tableware.

In other types of commercial establishments which have less demand for tableware washing, a variety of under the counter or above the counter dishwashers are used. Normally these dishwashers have a single rack of dishes which is inserted into the machine, washed for one or two minute cycles and withdrawn for re-use. With such low volume or low end industrial dishwashers, the use of electronically controlled detergent and rinse aid dispensing machines is not cost effective. In the past, for such low end dishwasher machines powdered detergents with or without rinse aids have been used. However, due to the highly caustic nature of the powders, operators of the machines often receive caustic burns and secondly do not always pay the necessary attention to ensure that the correct amount of detergent powder is included in the machine for each cycle. A further difficulty with the use of powders is the slow dissolution rate during the relatively short cleaning cycle. Furthermore, powders do not lend themselves to automatic dispensing within the dishwasher.

Powdered dishwasher detergents also present a problem from the standpoint of incorporation of rinse aids. The major problem in incorporating rinse aids in highly caustic industrial type dishwasher detergents, is that the rinse aid is not stable in the caustic composition, so that the effectiveness of the rinse aid is lost during storage and before use. Hence in most situations a separate rinse aid is used in conjunction with powdered dishwasher detergents.

Liquid dishwasher detergents are best suited for use particularly for industrial type dishwashers because of their ready dispersability in the dishwasher water and their relative ease of dispensing. Liquid dishwashing detergents are therefore commonly used in the larger capacity dishwasher machines because they may be readily pumped to within the dishwasher. As already mentioned however, the electronically controlled pumping systems for dishwasher detergent liquids are not cost effective with low end type dishwashing machines. Furthermore, to retrofit any type of external dispensing device requires drilling the cabinet and dishwasher tub to provide for installation of dispenser conduits to within the dishwasher.

A further difficulty with the use of liquid dishwasher detergents is that bulk supply of the liquid can present problems in filling reservoirs either positioned within the machine or on the exterior thereof. Spillage of the very caustic materials presents a considerable hazard to the operator as well as to surrounding equipment.

Although there are various types of dispensers available for dispensing powder into dishwasher machines, in view of the presence of moisture and heat in the dishwasher, the powder dispenser has to be of a design which avoids caking of the powders and subsequent malfunctioning of the equipment. For example, the powder dispensing device of U.S. Pat. No. 2,500,059 could not operate in the hot moist environment within a dishwashing machine. Similarly, the more complex electronic system of U.S. Pat. No. 4,875,607, although it would function adequately outside of a washing machine, could not function within the dishwashing machine because of the moist, hot environment. As to the dispensing of liquids to within the machine as already explained, there are the complex electronically controlled pump systems. However, there does not appear to be available in the marketplace any type of liquid dispensing device which operates consistently and may be positioned within the dishwasher.

SUMMARY OF THE INVENTION

In accordance with an aspect of this invention, a dispensing system is adapted for dispensing a dose of a liquid dishwasher chemical agent inside a dishwasher when the dispenser is mounted inside a dishwasher, the dispensing system comprising:

i) means for mounting the dispensing system inside a dishwasher;

ii) a container for a liquid dishwasher chemical agent;

iii) means for dispensing from the container a dose of a liquid dishwasher chemical agent to inside a dishwasher.

According to another aspect of the invention, a dispensing system is adapted for dispensing a dose of a liquid, the dispensing system comprising:

i) means for mounting the dispensing system to a support;

ii) means for metering a predetermined dose from a supply of a liquid and retaining the metered dose for dispensing;

iii) means for actuating the dose metering means to release the retained dose of a liquid, the actuating means being attached to the dispenser mounting means and moveable between a first non-dispensing position and a second dispensing position;

iv) the supply of a liquid being held in a container;

v) the container having an outlet for a liquid held in the container, the dose metering means being connected to the outlet and adapted to retain liquid in the container when the container is inverted for operative association of the dose metering means with the actuating means in its first or second positions;

vi) means for supporting the container in an inverted position with the dose metering means in operative association with the actuating means, the supporting means engaging a portion of the container to support the container in the inverted position, the supporting means being adapted to permit release of the container when replacement of the container is required, the supporting means being attached to the dispenser mounting means.

According to another aspect of the invention, an exchangeable container for liquid dishwasher chemical agent is provided. The container is adapted for use on a dispenser which is mounted inside a dishwasher. The container comprises:

i) an elongated, narrow, hollow bodied portion;

ii) an outlet for the container located at a lower most portion of the container, when the container is in an inverted use position on a dispenser;

iii) means for metering a dose of a liquid as such liquid would drain through the container outlet in an inverted use position on a dispenser, the metering means being connected to the container outlet and adapted to retain liquid in the container when in an inverted use position on a dispenser;

iv) the metering means has reciprocal means exterior of the container for engagement by a dispenser of the container whereby movement of the reciprocal means from a first non-dispensing position to a second dispensing position dispenses a metered dose of a liquid.

BRIEF DESCRIPTION OF THE DRAWINGS

Preferred embodiments of the invention are shown in the drawings wherein:

FIG. 10 is a section through the container and metering device with the actuating device returning to the non-dispensing position;

FIG. 11 is a section through the metering device showing the plunger returning to the first position with detail of the plunger sealing means;

FIG. 12 is a section through the metering device showing the plunger moving in a dispensing direction with of detail the plunger sealing means; and FIG. 13 is a section through the container with the metering device in the first non-dispensing position and a cap for retaining the metering device in that non-dispensing position.

DETAILED DESCRIPTION OF THE PREFERRED EMBODIMENTS

Figure 1:
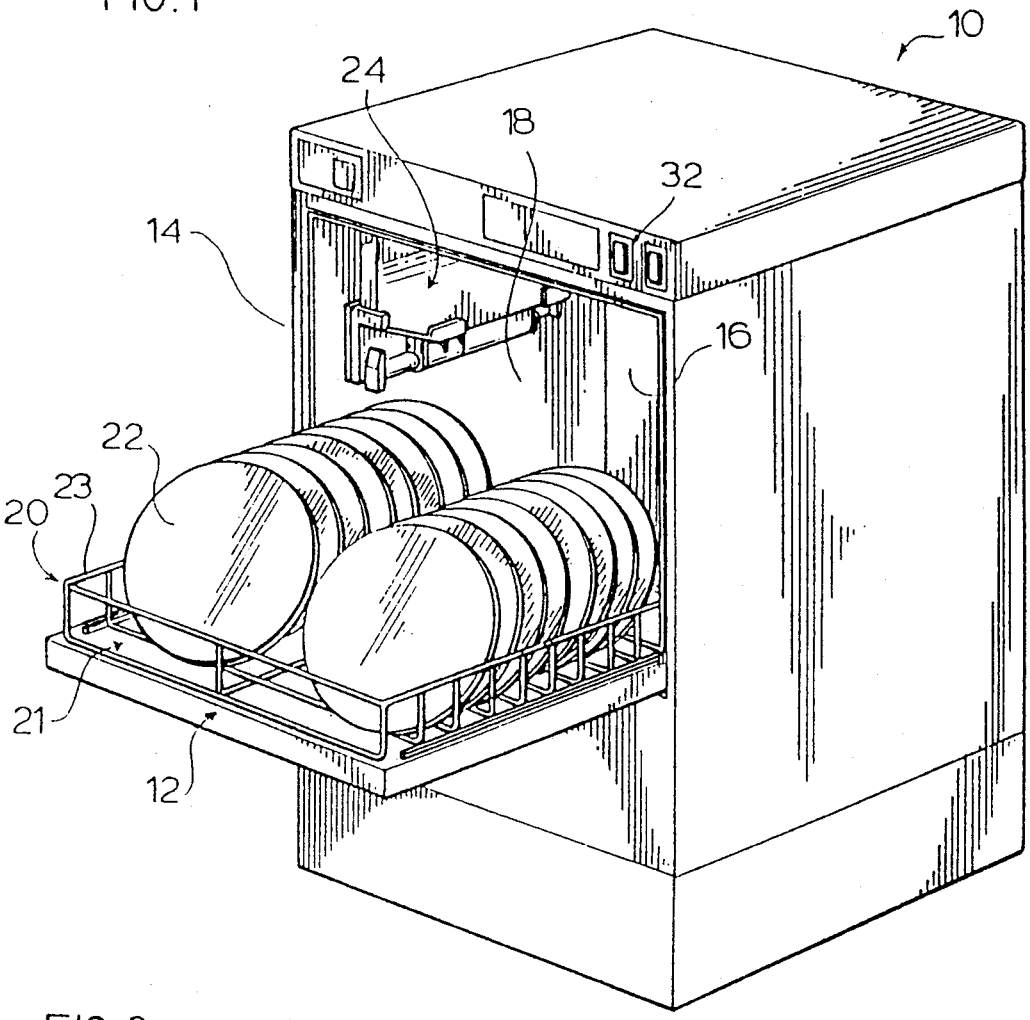
FIG. 1 is a perspective view of a dishwasher in which the dispensing system of this invention is mounted.

The dispensing system, according to this invention, not only lends itself for use inside dishwashers, but is also useful in dispensing a variety of types of liquids either to within various types of treatment machines or within various types of treatment vessels, vats and the like or within sinks, containers and the like which require on an intermittent basis a predetermined dose of treatment liquid. The dispensing system is adapted for use with either an integral container for the liquid to be dispensed or a replaceable container. The dispenser system, when set up with an integral container, may be discarded upon dispensing of all treatment liquid in the dispensing system. Alternatively, with a dispensing system having a replaceable container, the container may be removed and a fresh container loaded with treatment liquid replaced on the dispenser for use in the particular environment to which the dispensing system is adapted.

The dispensing system, according to this invention, is particularly suited for a reliable, easy to use dispensing of liquid dishwasher detergents into a variety of dishwashers. The dispensing system is of inexpensive construction and can be arranged within the dishwasher so that it is readily accessible and hence easy to use by the operator. According to a preferred aspect of the invention, product is readily loaded into the dispenser, providing a foolproof method of use by the operator to ensure that consistent dishwashing is provided.

Accordingly, an aspect of the invention is shown in the drawings which accomplishes these features, it being understood that the dispensing system, although shown in conjunction with an under- the-counter dishwasher, is readily usable in all other types of dishwashers due to its compact, slim nature. The preferred use for the dispensing system is in the "low end" type of dishwasher machines which are used to wash various types of tableware in smaller establishments. It is appreciated however that in some circumstances it may be desired to use the dispensing system in the "high end" of dishwashers where it is not feasible to use the standard types of electronic metering systems. A preferred aspect of the dispensing system of this invention, whether used in low end or high end type dishwashers, is the feature of the readily replaceable container for the dispenser to provide for reliable, consistent dishwashing by the operator. It is appreciated, however, that the container may be an integral part of the dispensing system. This is useful in applications where it is not desired to replace the container with the integral system. The container and dispenser may be discarded once all liquid in the container is dispensed.

With reference to a preferred embodiment of the invention as shown in FIG. 1, a standard type of under the counter dishwasher 10 is shown having a front door 12 to provide front opening access 14 to the interior cavity 16. The interior cavity 16 is defined by a standard type of dishwasher tub, having interior walls such as sidewall 18. The door 12 in the open position, supports a rack 20 holding a plurality of tableware in this instance, tableware 22 which require washing within the dishwasher 10. The rack 20 may be of the standard type for use in conjunction with the dishwasher 10. The rack 20 is slid from the door to within the dishwasher cavity 16 and supported by suitable supports within the dishwasher tub such as ledges and the like on the tub sidewalls.

A dispensing system 24, according to this invention, may be mounted on any suitable interior surface of the dishwasher tub. With this particular style of dishwasher, it is convenient to mount the dispenser on the sidewall interior surface 18. The mounting of the dispenser will be discussed in more detail with respect to FIGS. 3, 4 and 5. The dispenser is mounted in a manner so as to be readily accessible to the operator and to be readily viewed by the operator to determine the volume of detergent solution remaining in the dispenser.

It is appreciated that the dispensing system, according to this invention, may also be mounted on the dishwasher rack or some other convenient location inside the dishwasher. As previously mentioned, the dispenser and container may be an integral unit which is particularly suitable for mounting on the dishwasher rack. Each rack would carry an individual dispensing system and discarded and replaced with a new dispensing system including container when all treatment liquids in the container are used. The rack system 20 of FIG. 1 is rectangular in nature. In the forward portion of the rack 20 in the region generally designated 21, a suitable rectangular or cylindrical in shape dispensing system may be mounted on the wire portions 23 of the rack. By way cf a suitable actuator, liquid in the dispenser may be dispensed to within the dishwasher once the rack is slid to within the dishwasher and before the door 12 is closed. The dishwasher rack 20 is shown in phantom in FIG. 3 to illustrate one possible mounting of the system 24. One skilled in the art will realize that many different ways of mounting the system 24 inside a dishwasher 10 could be devised.

Figure 2:
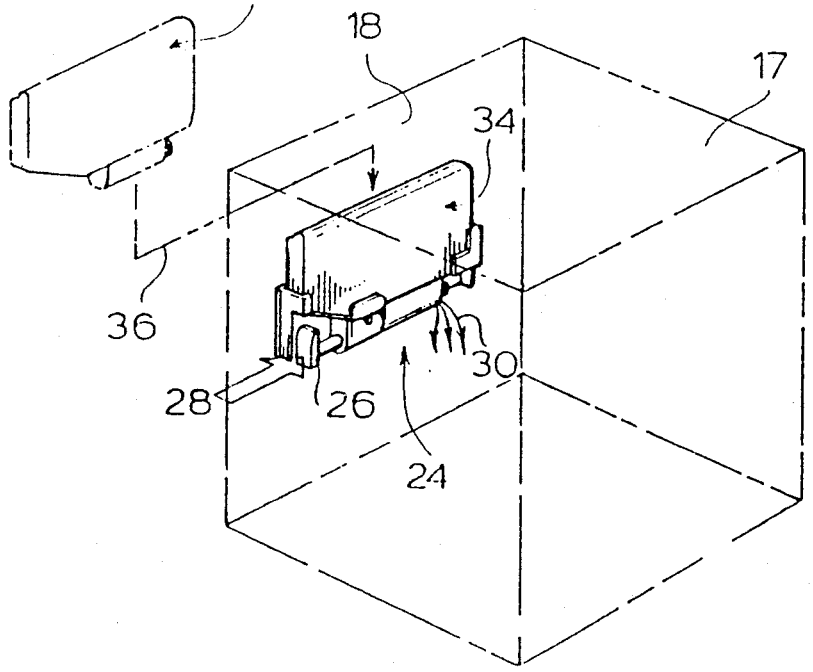
FIG. 2 is a perspective view of the dispensing system according to an embodiment of this invention demonstrating the interchangability aspect of the dishwashing detergent liquid supply container.

As shown in FIG. 2 the dishwasher tub 17 is shown in outline where the interior surface 18 has the dispenser 24 mounted thereon. Before commencing the cycle of the dishwasher, the dispenser is actuated to dispense into the dishwasher tub 17, a predetermined dose of dishwasher detergent solution. This is accomplished by the operator pushing the actuator slide or actuating device 26 in the direction of arrow 28 to cause a metered dose of dishwasher detergent liquid to be dispensed in the direction of arrows 30 to within the dishwasher tub 17. The front door 12 of the dishwasher is then closed and by operation of the control panel 32 of the dishwasher, the cycle begins to clean the dishes. Normally in institutional types of dishwashers, the cycle is in the range of one to two minutes long. During that period there is a wash cycle as well as a rinse cycle. The liquid dishwasher detergent is formulated to provide for both wash and, if desired, suitable rinsing of the dishes during the rinse cycle.

Although discussion of various preferred embodiments of the invention are related to the dispensing system being used to dispense dishwasher detergent liquid, it is understood that other types of liquid may be dispensed depending upon the type of use to which the dispensing system is put. For example, in using the dispenser for dishwasher application, the liquid may be a dishwasher chemical agent such as a descaling agent, a sanitizing agent, a rinse agent, a detergent, a water conditioning agent and the like. Other uses may involve the dispensing of liquids such as bactericidals, bleaching agents, oxidizing agents, acids and the like. It is understood that with liquid dishwasher chemical agents, some of the compositions as a liquid will be in the form of:

1. slurries (a solid in a liquid);
2. emulsions (a liquid in a liquid); or
3. solutions (total dissolution in the liquid of the active components).

It is therefore understood that, with respect to discussion of various embodiments of the invention, liquid is intended to cover slurries, emulsion and solutions and that liquid dishwasher chemical agents are intended to cover various types of components used in the dishwasher field.

By virtue of a dispenser being mounted within the dishwasher in a manner so as to be readily viewable, the operator can determine the level of dishwasher detergent liquid within the container 34. The dispenser is designed so as to provide for replacement of the container 34. The operator may readily remove container 34 and place container 34A in the dispenser 24 as indicated by arrow 36.

Several advantages flow from the replaceable aspect of the entire dispensing system or the container of dishwasher detergent liquid for the dispensing system. The operator is protected from exposure to very corrosive dishwasher detergent liquids because the operator need only remove the entire dispensing system or the empty container and insert a new system or a full container without having come in contact with the liquid. There is no need for the operator to attempt to pour liquid detergents into the dishwasher during each cycle or to fill any type of container which may have previously been used with dishwasher detergent liquid metering systems. The dispenser system of this invention also avoids the use of powders, which are normally dispensed to within the dishwasher by scoop or some other type of measuring device. In view of the ease with which particularly the containers are replaced, there is greater impetus for the operator to replace the container to ensure that the desired dishwasher detergent liquid is dispensed to within the dishwasher on a consistent basis.

Figure 3:
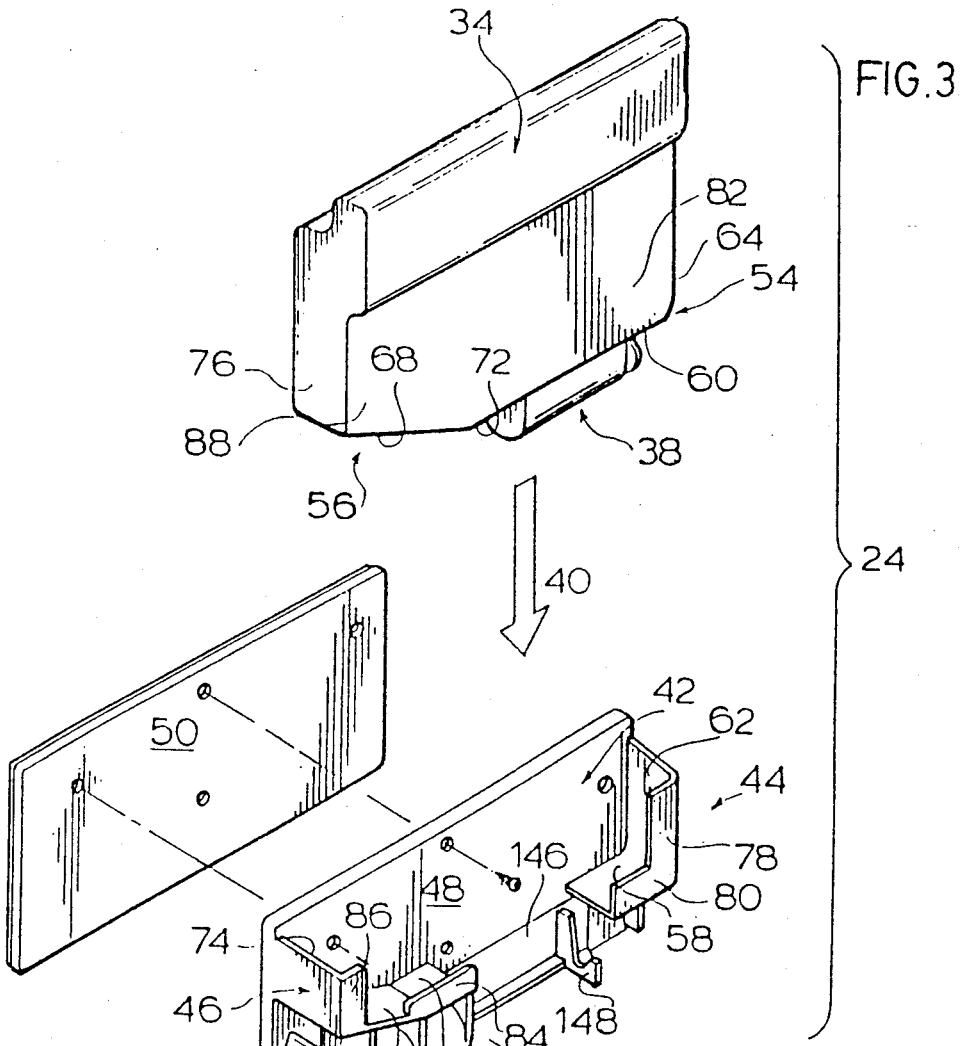
FIG. 3 is an exploded perspective view showing the mounting of the dispenser to a plate which in turn is adapted for attachment to an interior surface of a dishwasher.

With reference to FIG. 3, further details of the dispensing system 24 are shown in exploded view. The dispenser 24 comprises a replaceable container 34 which according to this embodiment includes a dishwasher detergent dose metering device 38. According to this embodiment, the container 34 is inserted in the direction of arrow 40 into a container support and dose actuating device 42. The dose actuating device 42 includes the dispenser actuator slide or actuating device 26 and a support device for the container defined by receptacle portions 44 and 46. Device 42 also includes a back plate 48 which is adapted for mounting to a dishwasher mounting plate 50. According to this embodiment, the backing plate 48 is fastened to the mounting plate 50 by self tapping screws 52.

The support portions 44 and 46 for the container 34 are shaped to receive portions of the container in a manner to support it in operative association with the dispenser actuator mechanism 26. According to this embodiment, the receiving portions 44 and 46 are designed to engage corner portions generally designated 54 and 56 of the container. Ledge portions 44 and 46 are shaped to conform to the shape of corner portions 54 and 56 of the container. Ledge portion 44 has a bottom 58 on which the base 60 of the container corner 54 rests. Upright ledge portion 62 rests against the upright edge 64 of the container. Sloping portion 66 of ledge portion 46 engages the bottom 68 of the container. The horizontal base portion 70 of the ledge engages the corresponding bottom portion 72 and the upright section 74 of the supporting ledge 46 engages the upright edge 76 of the container 34. Outside flanges 78 and 80 engage the outer surface area 82 of corner portion 54 of the container. Similarly, outside flanges 84 and 86 engage the outer surface 88 of corner portion 56 of the container. Under the influence of gravity, the container is thereby steadied by the ledge support portions 44 and 46 so as to be in operative engagement with the actuator slide in a manner to be discussed with respect to FIGS. 7, 8 and 9. By virtue of this ledge support system, the container is readily interchanged with a full container since the ledge portions 44 and 46 releasibly engage and support the container in the dispensing system.

Figure 4:
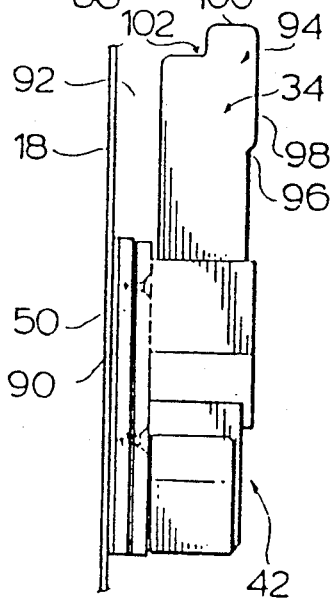
FIG. 4 shows the assembled dispensing system with the container as attached to an interior surface of a dishwasher.
Figure 5:
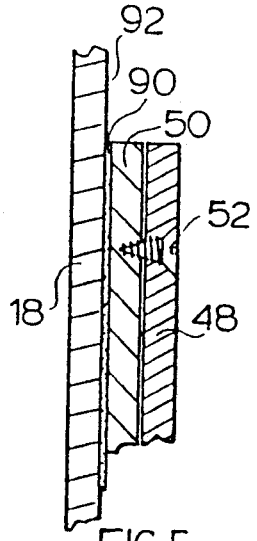
FIG. 5 is a section through the mounting plate for the dispenser according to an embodiment of this invention.

As shown in FIG. 4, the end view of the system illustrates a very slender, elongated compact system. The dishwasher tub wall 18 has the mounting plate 50 secured thereto by way of a suitable fastening medium 90. As shown in FIG. 5, the fastening medium 90 may be a pressure sensitive adhesive which firmly secures the mounting plate 50 to the interior surface 92 of the tub side wall 18. Also as shown in more detail in FIG. 5, the self tapping screws 52 firmly affixes the backing plate 48 to the mounting plate 50. The screws 52 do not penetrate through the tub wall 18, thereby ensuring a leak proof mounting of the dispenser system on the interior wall 18 of the tub.

Also as shown in FIG. 4, the dispensing system is mounted in a manner so as to space the container 34 slightly from the tub wall 18 as defined by space 92. By provision of the handgrip section generally designated 94, the operator can readily grasp by hand the container 34 to readily interchange another container in the dispenser actuating system 42. By virtue of the elongated slim structure, the container is readily grasped by the hand-held portion 94. The hand-held portion 94 is then defined by an undercut section 96, vertical section 98, a horizontal section 100 and recessed portion 102. In this manner, the container is readily grasped for easy replacement in the dispenser device 42 and also facilitates handling during packaging and uncrating.

Figure 6:
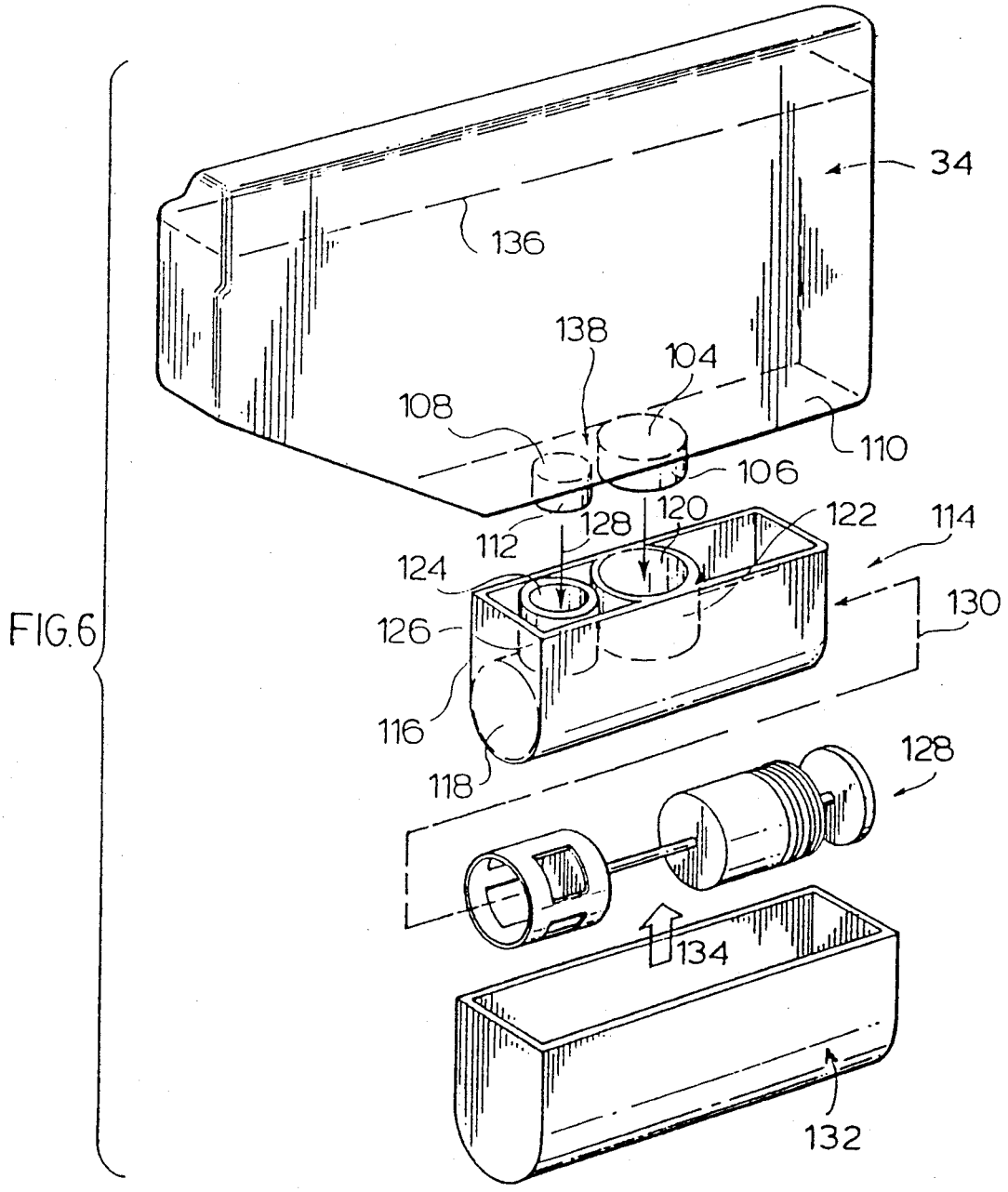
FIG. 6 is an exploded view of the container of this invention with the metering device attached thereto.

According to a preferred embodiment of the invention, the dose metering device is included on the container 34 in a manner to be discussed with respect to FIG. 6. It is appreciated however that the dose metering device may also be part of the dispensing actuator system 42. With reference to FIG. 6, the container 34 has an outlet opening 104 as shown in outline, which is defined by a circular outlet spout 106. According to this preferred embodiment, a liquid return system for the dose metering device is also provided. This return system is in the form of an aperture or second outlet 108 as shown in outline in the container bottom wall 110 and is defined exteriorly by spout 112. The metering device 114 comprises a housing 116 with a cylindrical chamber 118 defined therein. A circular bore 120 defined by annular flange 122 envelops the spout 106. Similarly circular bore 124 defined by annular flange 126 envelops spout 112. Hence when the container 34 is inserted in the direction of arrows 129, the bore surfaces 120 and 124 are dimensioned to snugly receive the exterior surfaces of the spouts 106 and 112 to sealingly engage those surfaces. It is appreciated then, when required to ensure a leak-proof connection, a flexible ring seal may be located on the spout surfaces 106 and 112.

Such inner connection of the metering device to the container 34 is desired in instances where refillability of the container is desired. It is appreciated, however, that with throw-away models the metering device 114 may be sonically welded to the container spouts 106 and 112 to form a permanent connection.

Within the cylindrical chamber 118, a plunger arrangement 128 is inserted in the direction of arrow 130. The function of this plunger system in metering a dose of dishwasher detergent liquid and dispensing same shall be discussed with respect to FIGS. 8, 9 and 10. With the plunger system in place in the cylindrical chamber 118, a shipping cap 132 is provided which in accordance with this embodiment envelopes the metering device and the plunger to hold the plunger in place and prevent liquid from not draining from the container during shipping or other handling. The manner in which this will be achieved will be discussed in more detail with respect to FIG. 13. The shipping cap is placed over the assembled container as demonstrated in the direction of arrow 134.

The container 34 is preferably made of a translucent or transparent material so that the liquid level 136 is visible to the operator. There are a variety of blow moldable plastics which are readily suited to this application. The plastics may be of recyclable material or of material which permits rinsing and reuse of the existing container. As discussed with respect to FIG. 3, the support ledges 44 and 46 are shaped to permit clear viewing of the bottom region 138 of the container so as to visually indicate by liquid level 136 when the container is almost empty. In this manner, indication of replacement for the container is readily evident to the operator.

Figure 7:
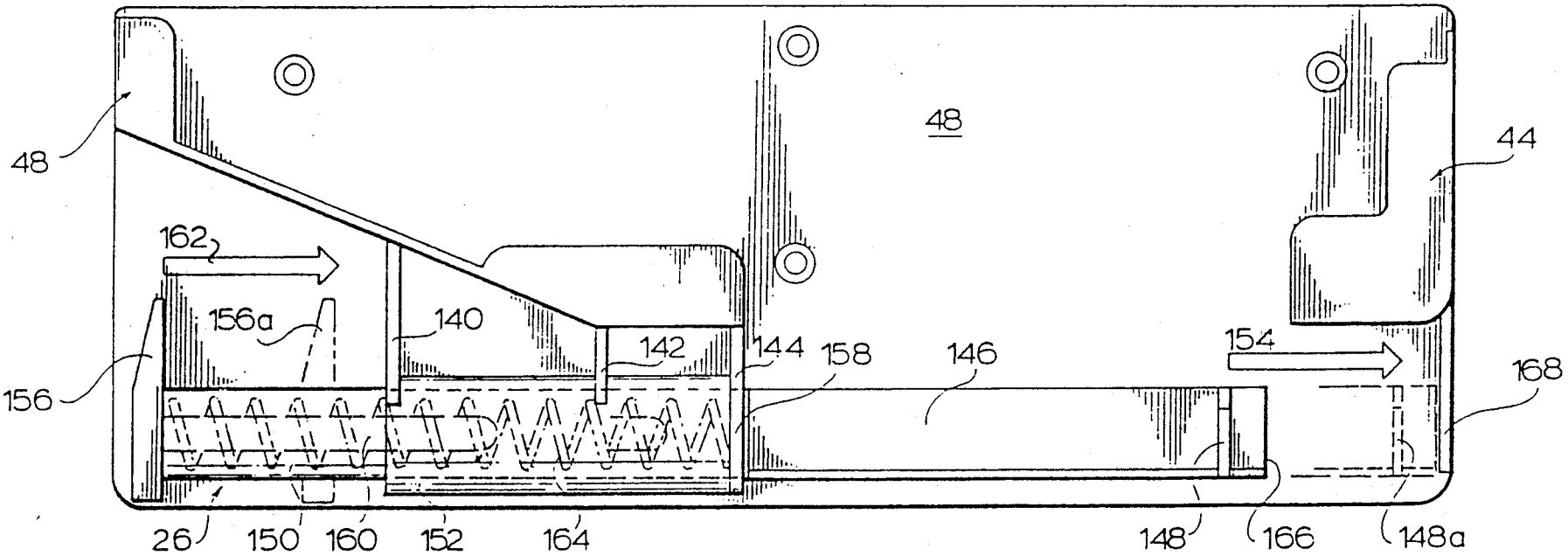
FIG. 7 is a side elevation of an actuator for actuating the device as mounted on the container in accordance with the embodiment of this invention.

As shown in FIG. 7 in accordance with the embodiment of this invention, the dose metering actuator slide or actuating device generally designated 26 is shown as well as the structure of the container supporting ledges 44 and 46. The actuating device 26 is mounted to the backing plate 48 by way of struts 140, 142 and 144. The actuating device 26 includes a slide member 146 carrying a plunger engaging device 148. The manner in which it engages the plunger of the dose metering device shall be discussed in more detail with respect to FIG. 8. The plunger engaging device 148 in accordance with this embodiment is shown in more detail in FIG. 3 and consists of a "U" shaped member secured to the slide 146. Should the slide be made from a injection moldable plastic, the plunger engaging member 148 would be integrally molded therewith. The slide 146 is secured to a reciprocal spring-loaded guide 150 adapted for reciprocal movement within mating channel 152. The guide 150 is connected to the slide 146 through the back plate 48 whereby reciprocal movement of the guide 150 causes corresponding movement of the slide 146 in the direction of arrow 154. To provide for automatic return of the actuator push button 156, a spring is enclosed within the guide 150. The chamber 152 has a blind end indicated at 158. The coiled spring is positioned within the channel 152 and within the guide 150. The guide 150 carries a spring stabilizer 160 so that as the spring is compressed, it does not bend radically out of shape so as to cause jamming of the system. Hence, movement of the push button 156 in the direction of arrow 162, compresses the coiled spring 164 within the chamber 152 and guide 150 until the distal end 166 of the slide 146 abuts a stop 168. Hence in accordance with this dispenser system, the actuator has a first non-dispensing position as defined by the plunger engaging device being in the position shown in solid line. However, when the actuator button 156 is moved to position 156*a*, as shown in dot, and the plunger engaging device is correspondingly moved to position 148 A as shown in dot, the actuator is then in the second dispensing position. By virtue of the slide mounting, the actuator is then allowed to reciprocate between the first non-dispensing position and the second dispensing position. In accordance with this preferred embodiment, the release of the metered liquid does not commence until the plunger has moved to the second dispensing position. This avoids a gradual release of the dose or a pressurized injection of the dose of liquid. By use of a coiled spring 164, automatic return of the actuator to the first non-dispensing position is thus achieved, the function of which will be described in more detail with respect to FIG. 10.

Figure 8:
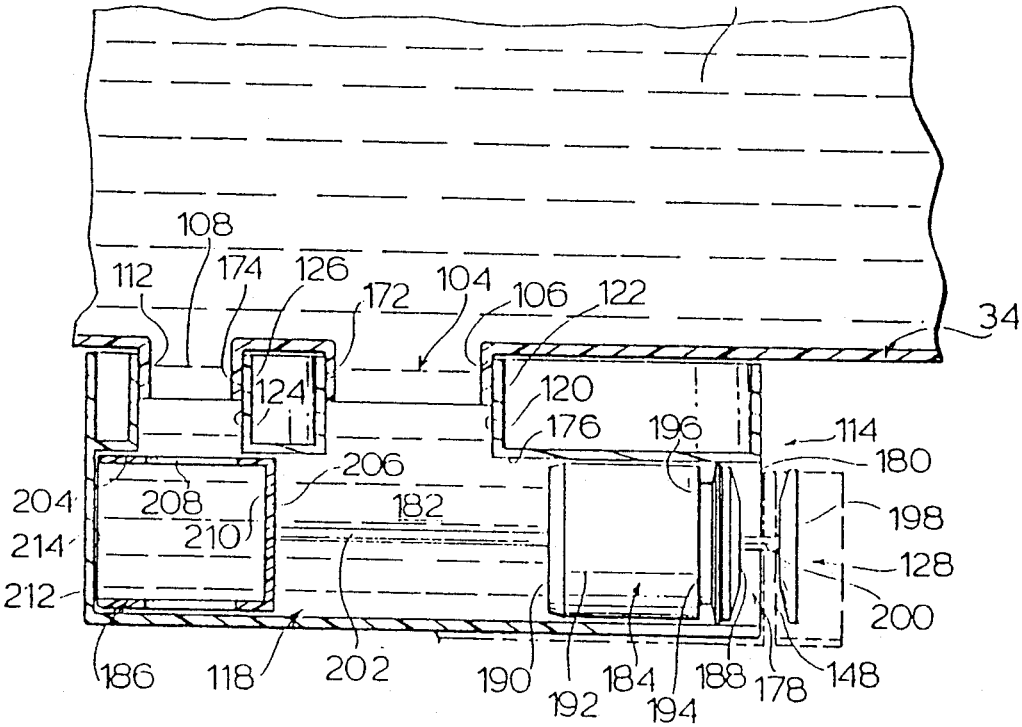
FIG. 8 is a section through the container and metering device with the actuator in a first non-dispensing position.
Figure 9:
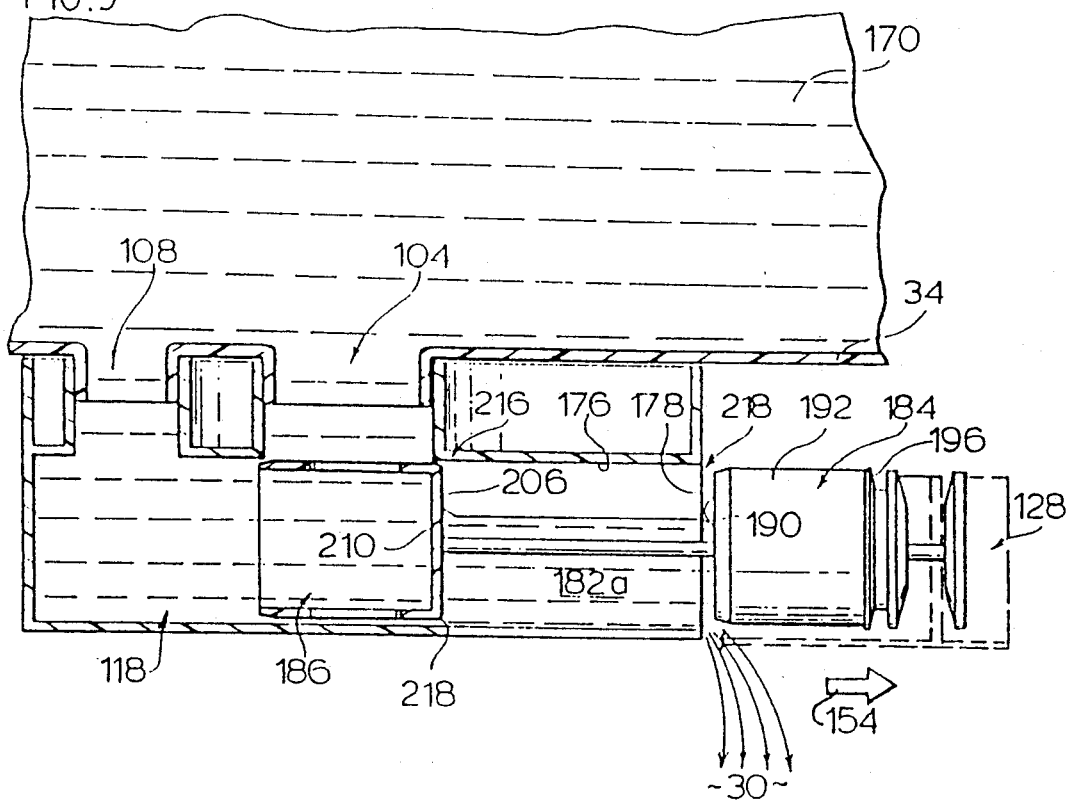
FIG. 9 is a section through the container and metering device with the actuator in a second dispensing position.

With reference to FIGS. 8, 9 and 10, the dispensing of a metered dose of dishwasher detergent liquid shall be discussed. In accordance with this embodiment of the invention, the dose metering device 114 not only serves to meter from liquid 170 within a container 34 the desired quantity of dishwasher detergent liquid, but also serves to retain the liquid in the container when it is in its inverted use position. This is accomplished by positioning the plunger mechanism within the metering device 114 in the first non-dispensing position as shown in FIG. 8. As already explained with reference to FIG. 6, the container has a dishwasher detergent outlet 104 defined by spout 106. The metering device has a bore 120 defined by circular flange 122 for sealingly engaging the spout 106 at the interface 172. Similarly return flow aperture 108 as defined by the spout 112 is encompassed by smooth bore 124 defined by flange 126. The smooth bore 124 is dimensioned to engage the spout 112 to provide a leak tight interface at 174. The leak tight inner connections at 172 and 174 secure the dose metering device 114 to the container. It is appreciated of course that for nonrefillable uses the dose metering device may be sonically welded to the plastic of the container as desired. The metering device 114 has a chamber 118 as defined by interior cylindrical wall 176. The chamber 118 is open-ended at 178 as defined by the circular open end 180. Openings 104 and 108 are in communication with the chamber 118. The plunger device 128 defines the portion of the chamber which meters a predetermined dose of the dishwasher detergent liquid 170 from the container 34. The plunger device 128 defines a chamber portion 182 which effects the metering of the predetermined dose of dishwasher detergent liquid. This portion is defined by plunger segments generally designated 184 and 186.

The forward segment 184 of the plunger device consists of a plunger having a front face 188 and a rear face 190. A cylindrical portion 192 is slightly less than the interior diameter of the chamber 118. Cylindrical portion 192 includes an annular grove 194 within which a sealing ring 196 is provided. The sealing ring sealingly engages the circular interior surface of the chamber 118 to seal and thereby prevent escape of liquid beyond the seal 196 to the exterior of the open-ended chamber 118. The function of the seal shall be discussed in more details with respect to FIGS. 11 and 12. Attached to the forward face 188 of the plunger is a button member 198 secured to the forward face by shaft 200. With the plunger mechanism 128 in the first non-dispensing position, as shown in FIG. 8, and by virtue of inserting the container into the dispenser mechanism 42, the plunger engaging yoke portion 148 fits behind the button 198 as shown in dot at 148 in FIG. 8.

The second plunger segment 186 is connected to the first plunger segment 184 by means of a shaft 202. The second segment consists of a cylindrical hollow piston member 204 having a front face 206. The cylindrical piston 204 has in its side walls apertures 208 to allow liquid through aperture 108 to flow into the hollow piston and up against the rear face 210 of the hollow piston as the plunger is moved from the first non-dispensing position to the second dispensing position. The rear portion 212 of the hollow piston abuts the rear face 214 of the chamber to act as a stop in defining the first non-dispensing position of the plunger mechanism. In this way, the button 198 is sufficiently spaced from the open end 178 of the chamber such that as the container is placed in the receptacle portion of the dispenser actuating device, the yoke 148 of the plunger engaging mechanism slides neatly behind the button 198 so as to engage the button 198 for purposes of reciprocating the plunger mechanism between the first and second positions.

As the plunger mechanism is moved from the first non-dispensing position to the second dispensing position as shown in FIG. 9, several events happen during a movement to effect a dispensing of a predetermined dose of dishwasher detergent liquid. With the chamber 182 filled with liquid, actuation of the button 156 of the slide 146, moves the plunger in the direction of arrow 154. This is usually a fairly rapid movement, so that piston face 206 moves across the outlet 104 and into the region designated 216 where the perimeter 218 of the piston face is blocking or minimizing any further flow of dishwasher detergent liquid from outlet 104 into the chamber area now defined at 182*a*. As this occurs, the seal 196 for the plunger segment 184 has moved out through the open end 178 of the chamber until as shown in FIG. 9, with the piston face 206 in engagement with the interior cylindrical surface 176 of the chamber, the entire plunger cylindrical portion 192 is outside of the chamber 118. With the rear face 190 in the position shown in FIG. 9, the dishwasher detergent liquid is free to flow in the direction of arrows 30 so as to be dispensed within the dishwasher. This second dispensing position for the plunger mechanism 128, is defined as shown in FIG. 7, by the distal end 166 of the slide abutting the stop 168.

Depending upon the viscosity of the liquid to be dispensed, the time during which the rear face 190 of the plunger should remain outside of the chamber to release the entire dose of liquid is thereby determined. For less viscous liquids such as liquids with a viscosity close to that of water, a very short dwell time is required, whereas for more viscous liquids, a longer dwell time during which the liquid drains from the chamber 182A is required. This particular embodiment is adapted to dispense liquids of a viscosity similar to water so that a very short dwell time is required to release the liquids. Hence, the spring functions in a suitable manner such that by the time the operator has released the actuator button, all liquid is dispensed from the chamber 182A and the plunger mechanism can then be returned to its non-dispensing position in a manner to be discussed with respect to FIG. 10.

It is appreciated however that with more viscous liquids it may be desirable to provide some form of restraint to delay returning the plunger mechanism to the first non-dispensing position. This may be accomplished in a variety of ways, using either compressible or non-compressible fluids in a closed chamber behind the piston face 210 to slowly permit the return of the plunger mechanism to the first non-dispensing position. Alternatively, the rate of return of the plunger mechanism to the first non-dispensing position can be controlled by varying the size of the second outlet 108. The spring 164 biases the plunger to the first non-dispensing position. Fluid, which is moved into chamber region 118 through second outlet 108 and in behind the piston against face 210, is returned to within the container through outlet 108 when the plunger moves to the first non-dispensing position. The apertures 208 in the piston arrangement 186 may be closed to contain the liquid in the chamber area 118 behind the piston face 210. As will be discussed with respect to FIG. 10, by varying the size of the outlet 108 the rate of return of the plunger mechanism can be controlled.

Chamber **182*a* defines the volume of the metered dose of dishwasher detergent liquid. This is effectively the same as the volume within the chamber 118 as defined between faces 190 and 206 of the plunger segments 184 and 186. It is appreciated that the volume of this chamber may be varied by changing the distance between the faces or altering the length of the plunger cylindrical segment 192. This provides for various metered doses of dishwasher detergent liquid as required for various applications. Normally the movement of the plunger mechanism from the first and second position is sufficiently expedient to prevent excessive drainage of liquid from outlet 104 into chamber 182*a* after the plunger seal 196 has moved beyond the open end 178 and before the piston face 206 engages region 216 of the cylindrical interior face 176 of the chamber 118. Similarly on the return of the plunger mechanism to the first position from the second position, the travel is sufficiently expedient to minimize the drainage of dishwasher detergent liquid from the container 34** into the dishwasher.

While liquid drains from chamber **182*a*, in the direction of arrows 30, air enters the chamber 182*a* through opening 218. Once the plunger mechanism 128 is returned to the first position, air is then trapped in chamber 182*a*, the purpose of which is to vent to container 34 so that the next charge of dishwasher detergent liquid can flow into the chamber 182 when the plunger is in the first non-dispensing position. With reference to FIG. 10, the return of the plunger mechanism 128 towards the first non-dispensing position is demonstrated by arrow 220. As shown in FIG. 10, chamber 182*b* commences filling with liquid detergent from outlet 104 as demonstrated by the direction of flow of arrows 222. The lower region of the chamber 182*b* fills with liquid detergent 170*a*. The detergent is contained in this region by virtue of the rear face 190 of the plunger segment 184 being in contact with the cylindrical interior surface 176 of the chamber 118. At the same time air which was contained in the chamber 182*a* and now 182*b* bubbles upwardly in the form of bubbles 224 in the direction of arrows 226. In this way pressure is equalized within the container 170 to allow liquid to flow through the outlet 104 into the chamber 182*b* while the necessary air flows upwardly into the empty space inside the container above the liquid level. It is of course appreciated that should additional venting for the container be required or, because other dispensing devices venting cannot be arranged as demonstrated in FIG. 10**, a suitable check valve type mechanism may be included in the container to permit air to flow into the container as liquid is dispensed, but prevents flow of liquid to the exterior of the container when liquid is up against the venting mechanism.

To avoid the need for a tight seal of the piston 186 with the cylindrical interior of the chamber 118, liquid is allowed to flow within the cylinder through apertures 208 against the rear face 210 of the piston. In returning the plunger arrangement to the first non-dispensing position, liquid behind the piston 186 is forced upwardly in the direction of arrows 228 through the aperture 108 back into the container 34, hence any liquid which leaks between the cylindrical surface of the piston 186 and the chamber interior wall is allowed to move freely behind the piston face so that the force of the spring 164 is sufficient to return the plunger to the first non-dispensing position. Once the plunger mechanism is returned to the position of FIG. 8, the chamber 182 is then full of dishwasher detergent liquid in readiness for dispensing the next dose of dishwashing detergent liquid to the inside of the dishwasher.

As noted with respect to FIG. 8, the return of the plunger mechanism to the first non-dispensing position under the bias of a suitable biasing device, such as spring 164, can be controlled by modifying the piston arrangement. The openings 208 in the piston may be closed. Liquid is then contained in the chamber 118 behind the piston face 210. As the plunger is returned to the first non-dispensing position, the liquid is returned into the container in the direction of arrows 228 through second outlet 108. By decreasing the size of opening 108, the rate at which the liquid is returned to the container can be controlled. With more viscous liquids, it is desired to have the plunger mechanism remain for an extended period of time in the second dispensing position. Depending upon the viscosity of the liquid, the size or dimension of the second outlet 108 may be selected to provide a slow rate of return of the viscous liquid into the container. This slow rate of return of the liquid correspondingly provides for a controlled slow rate of return of the plunger to the first non-dispensing position. Depending upon the biasing force exerted by the spring, and the size of outlet 108, the plunger rate of return to the first non-dispensing position can thereby be controlled to ensure that when the plunger is in the second dispensing position, all of the desired premetered dose of liquid is dispensed.

To ensure an effective seal of the plunger segment 184 with the interior 176 of the chamber 118, a wiper seal of the type shown in FIGS. 11 and 12 is used. The wiper seal is contained in the annular space 194 as mounted on spindle 230. The wiper seal is a ring dimensioned to engage the interior surface 176 of the chamber 118 as supported by the spindle 230. The wiper seal in the form of an annular ring 232 then slopes in the manner shown in FIG. 11 when the plunger mechanism is returned in the direction of arrow 220. The rear face 234 of the front face 188 of the plunger supports the sealing ring 232 as the plunger moves in the direction of arrow 222. Conversely when the plunger moves in the direction of arrow 154, the sealing ring 232 slopes in the opposite direction and is supported by interior face 236 of the plunger. This type of sealing mechanism forms an effective seal regardless of the direction of travel of the plunger and also compensates for variations in the dimensioning of the interior surface 176 relative to the plunger. This type of seal does not necessitate a low tolerance in the dimensioning of the cylinder and piston seal, so that the components may be injection molded from suitable plastics.

To enhance the sealing of the plunger with the cylindrical interior face 176 of the chamber, two sealing rings 232 may be employed. The spindle 230 may have centrally located thereof a raised ridge where a sealing ring 232 is placed on each side of the ridge. The dual sealing action on the interior face 176 of the chamber further enhances the sealing to retain liquid within the container. The open ended portion 218 of the chamber may also be chamfered to assist in the return of the plunger to within the chamber. This facilitates the return of the plunger particularly when two sealing rings 232 are employed. It has also been found that with a chamfer at the open ended portion of the chamber, the second sealing ring provides a snap action in returning the plunger completely within the chamber. Such snap-action closure is particularly useful for shipping purposes to ensure that the plunger does not move outwardly of the chamber; it being understood, of course, that the shipping cap 132 prevents the plunger from moving outwardly of the chamber to any extent which would allow leakage. It is also appreciated that the plunger engaging device 148 may be chamfered slightly at its upper end to act as a lead-in in engaging the button 128, particularly when the plunger is in its first non-dispensing position fully seated in the chamber as removed from the shipping package.

It is appreciated that during handling and shipping, the plunger mechanism 128 should be retained in the first non-dispensing position within the metering device 114. With reference to FIG. 13 and in accordance with this embodiment, this is ensured by use of a shipping cap 132 which is dimensioned to fit snugly over the housing 116 for the metering device. The shipping cap 132 has end plates 238 and 240 and plate 238 abuts the corresponding end 242 of the housing of the metering device. End plate 240 is positioned to be spaced slightly from button 198 of the plunger device 128 to hold the plunger mechanism in the first non-dispensing position. In this way, the seal 232 is in sealing engagement with the interior surface 176 of the chamber 118 to prevent any leakage of dishwasher detergent liquid from the container during shipping and handling. Once it is desired to place a container in the dispenser, the shipping cap 132 is removed to expose the button 128 whereby the container is positioned in the receptacle of the dispenser actuating mechanism in the manner discussed with respect to FIG. 8. It is appreciated that other mechanisms may be used to secure the plunger mechanism in the first non-dispensing position. For example, a suitable security seal of severable material may be wrapped over the button and secured to the housing for the metering device. Such severable material could be broken by the slide mechanism when the container is put in the use position on the dispenser actuating device.

In accordance with this discussion of preferred embodiments of the invention, it is appreciated that the dispenser is particularly suited for use in conjunction with dishwasher machines. Consistent dispensing of a dose of dishwasher detergent and safe replacibility of the detergent liquid containers are assured with each embodiment. The operator is capable of determining upon a glance if there is detergent in the system for dispensing and, if not, a replacement is readily inserted. The shipping and handling of the very caustic corrosive dishwasher detergent liquids is insured and operator hazards are considerably reduced, hence enhancing the use of this system by the operator to ensure repeated delivery of the necessary dishwasher detergent liquid to within the machine to provide for proper washing of the tableware. The system is compact and slim in nature so that it can be placed or mounted on the interior surface of a variety of types of dishwashers, whether it be on an interior surface of the tub or on an interior surface of the door of the dishwasher. Although a manual system has been described with respect to the dispenser, it is appreciated that a variety of other mechanisms may be employed whether they be mechanical or electrical to effect a dispensing of a metered dose of dishwasher detergent liquid. Such mechanical devices may be actuated by either insertion of the tray of tableware to be cleaned into the dishwasher or by the closing of the dishwasher door. Electrical devices could be used to sense the closure of the dishwasher door or to sense humidity or temperature within the dishwasher so as to shift the plunger mechanism to dispense detergent liquid from the container.

Although preferred embodiments of the invention have been described herein in detail, it will be understood by those skilled in the art that variations may be made thereto without departing from the spirit of the invention or the scope of the appended claims.

We claim:

1. A dispensing system adapted for dispensing a dose of a liquid dishwasher chemical agent inside a dishwasher when said dispensing system is mounted inside a dishwasher, said dispensing system comprising:

(a) means for mounting said dispensing system inside a dishwasher;

(b) a container for a liquid dishwasher chemical agent, said container being removable from said dispensing system to permit replacement of said container;

(c) means for dispensing from said container a dose of a liquid dishwasher chemical agent to inside a dishwasher; and (d) said container having an outlet through which fluid may flow, and means connected to said outlet to retain liquid in said container when inverted for placement in said dispensing system, said dispensing means comprising means for actuating said liquid retaining means to dispense a dose of liquid.

2. A dispensing system of claim 1, wherein said mounting means is adapted to mount said dispensing system on an interior surface of a dishwasher.

3. A dispensing system of claim 1, wherein said mounting means is adapted to mount said dispensing system on a rack for insertion in a dishwasher.

4. A dispensing system of claim 1 wherein said retaining means includes means for metering a predetermined dose of a liquid which is dispensed on actuation of said retaining means by said actuating means.

5. A dispensing system adapted for dispensing a predetermined dose of a liquid, said dispensing system comprising:

i) means for mounting said dispensing system to a support;

ii) means for metering a predetermined dose from a supply of a liquid and retaining said metered dose for dispensing;

iii) means for mechanically actuating said dose metering means to release said retained metered dose of a liquid, said actuating means being attached to said mounting means and moveable between a first non-dispensing position to a second dispensing position in which said metering means releases said retained metered dose of a liquid;

iv) said supply of a liquid being held in a container;

v) said container having an outlet for a liquid held in said container, said dose metering means being connected to said outlet and adapted to retain liquid in said container when said container is inverted for operative association of said dose metering means with said actuating means in its first or second positions;

vi) means for supporting said container in an inverted position with said dose metering means in operative association with said actuating means, said supporting means engaging a portion of said container to support said container in said inverted position, said supporting means being adapted to permit release of said container when replacement of said container is required, said supporting means being attached to said dispenser mounting means.

6. A dispensing system of claim 5 adapted for dispensing a dishwasher detergent liquid inside a dishwasher when said dispensing system is mounted inside a dishwasher;

said mounting means being adapted to mount said dispensing system inside a dishwasher;

said metering means metering a predetermined dose of a dishwasher detergent liquid from said container.

7. A dispensing system of claim 6, wherein said mounting means is adapted to mount said dispensing system on an interior support surface of a dishwasher.

8. A dispensing system of claim 6, wherein said mounting means is adapted to mount said dispensing system on a rack for insertion in a dishwasher.

9. A dispensing system of claim 7 wherein said dose metering means includes means for reciprocating in a chamber which is in liquid communication with said container outlet, said actuating means operating on said reciprocating means to reciprocate said reciprocating means between said first non-dispensing position whereby a metered dose of a dishwasher detergent liquid is retained in said chamber and said second dispensing position whereby a metered dose of a dishwasher detergent liquid is released from said chamber.

10. A dispensing system of claim 9 wherein said dose metering means includes means for venting said container when said actuating means returns said reciprocating means to said first non-dispensing position.

11. A dispensing system of claim 9 wherein said reciprocating means comprises a plunger adapted for reciprocal movement in said chamber between said first and second positions, said plunger having a front face and a rear face, means for sealing an outer periphery of said plunger between said front and rear faces with an interior surface of said chamber, a portion of said chamber behind said rear face of said plunger when said plunger is in said first position defining a volume for a metered dose of a dishwasher detergent liquid, said chamber having means to release a dose of dishwasher detergent liquid when said plunger is moved to said second position.

12. A dispensing system of claim 11 wherein said means for releasing a dose of dishwasher detergent liquid is an aperture beyond which said plunger travels.

13. A dispensing system of claim 11 wherein said means for releasing a dose of dishwasher detergent liquid is provided by said chamber being open ended in a direction forward of said plunger front face, said plunger seal means when moved to said second dispensing position extending beyond said chamber open end, is moved sufficiently to release a dose of detergent liquid from said chamber.

14. A dispensing system of claim 10 wherein said venting means allows air to enter said container while said reciprocating means returns to said first non-dispensing position.

15. A dispensing system of claim 11 wherein said plunger in said second position allows air to enter said chamber through said release means while a dose of dishwasher detergent flows through said release means, air in said chamber venting said container when said plunger returns to said first position.

16. A dispensing system of claim 9 wherein said actuating means comprises a reciprocal slide, said slide having means for connecting to said reciprocating means when said container is located in said support means, said slide being adapted for manual movement between said first non-dispensing and said second dispensing positions.

17. A dispensing system of claim 16 wherein means biases said slide to said first position.

18. A dispensing system of claim 11 wherein said chamber has a cylindrical interior surface and said sealing means engages said cylindrical interior surface, said chamber being open-ended in a direction outwardly of said front face to define thereby an open-ended portion of said chamber, guide means connected to and spaced from said rear face of said plunger, said guide means contacting said cylindrical interior surface during reciprocal movement of said plunger, said plunger when moved to said second position positioning said sealing means beyond said open end sufficiently to release a dose of dishwasher detergent liquid, said guide means remaining within said chamber to support said plunger in said second position and guide return of said plunger sealing means to within said chamber.

19. A dispensing system of claim 18 wherein said guide means has means in contact with said cylindrical interior surface and positioned relative to said plunger to block flow of a dishwasher detergent liquid through said container outlet into said chamber towards said open ended portion of said chamber when said plunger is in said second position.

20. A dispensing system of claim 19 wherein said means for blocking flow of a dishwasher detergent liquid comprises a cylindrical piston which contacts said cylindrical interior surface and is located relative to said plunger such that when said plunger is in said second position, said piston is in a position to block flow of a dishwasher detergent liquid from said container outlet towards said open ended position of said cylinder.

21. A dispensing system of claim 20 wherein means biases said actuating means to said first position and means for controlling rate of return of said plunger towards said first position as biased by said biasing means, said rate of return control means comprising:

i) said container having a second outlet in communication with said dose metering means and located behind said cylindrical piston in a direction away from said open-ended portion of said cylinder, whereby liquid flows from said container into said chamber behind said piston as said plunger is moved to said second position by said actuating means;

ii) said second outlet being dimensioned for a particular viscosity of a liquid to be dispensed to control rate of return of liquid through said second outlet as said plunger is returned to said first position by said biasing means by virtue of said piston moving rearwardly into said cylinder to return liquid into said container through said second outlet, said dimensioned second outlet in controlling rate of return of liquid into said container in turn controlling rate of return of said plunger, said rate of return of said plunger from said second position being such to ensure release of a predetermined dose of liquids.

22. A dispensing system for dispensing a metered dose of a liquid, said dispensing system comprising:

(i) a support for receiving and supporting a container thereon, the support comprising a reciprocal slide, the slide being moveable between a first position and a second position;

(ii) a container having a hollow interior for holding liquid, the container having an outlet and having a cylindrical chamber formed therein for receiving a plunger, the chamber having a cylindrical interior surface and having an open-ended portion for dispensing liquid outwardly therefrom, the container comprising a plunger disposed in said chamber and adapted for reciprocal movement therein between a non-dispensing position corresponding to the first position of the slide and a dispensing position corresponding to the second position of the slide, the plunger having a front face and a rear face and comprising means for sealing an outer periphery thereof between said front and rear faces with the interior surface of said chamber, a portion of said chamber behind said rear face of said plunger defining a volume for a metered dose of liquid when said plunger is in said non-dispensing position, said container further comprising a cylindrical piston which contacts the cylindrical interior surface of the chamber, the cylindrical piston being connected to and spaced from said rear face of said plunger and adapted to block liquid flow from the container into the chamber when the plunger is in the dispensing position; and (iii) means for mounting said dispensing system to a support, said plunger comprising a first part of a connector extending outwardly of said open ended chamber, said reciprocal slide comprising a second part of said connector, said first and second connector parts engaging one another to connect said slide to said plunger as said container is inserted into said support.

23. A dispensing system of claim 22 wherein said slide is biased to said first position by a mechanical-corrosion resistant spring.

24. A dispensing system of claim 23 wherein said sealing means is an annular wiper seal located on said plunger to seal against said cylindrical interior surface of said chamber as said plunger is reciprocated along said chamber by said slide.

25. An exchangeable container for liquid dishwasher chemical agent and which is adapted for use on a dispenser which is mounted inside of a dishwasher, said container comprising:

i) an elongated, narrow, hollow body portion;

ii) an outlet for said container located at a lowermost portion of said container when said container is in an inverted use position on a dispenser;

iii) means for metering a dose of liquid dishwasher chemical agent as such liquid would drain through said container outlet in an inverted use position on a dispenser, said metering means being connected to said container outlet and adapted to retain liquid in said container when in an inverted use position on a dispenser;

iv) said metering means having reciprocal means exterior of said container for engagement by a dispenser for said container whereby movement of said reciprocal means from a first non-dispensing position to a second dispensing position, dispenses a metered dose of liquids.

26. An exchangeable container of claim 25 wherein means is removably provided on said metering means to hold said reciprocal means in said first non-dispensing position whereby said metering means retains liquid in said container.

27. An exchangeable container of claim 25 wherein said metering means comprises:

i) a chamber in communication with said container outlet, ii) a plunger for reciprocal movement in said chamber between said first and second positions, said plunger having a front face and a rear face, iii) means for sealing an outer periphery of said plunger between said rear and front faces with an interior surface of said chamber, a portion of said chamber behind said rear face of said plunger when said plunger is in said first position defining a volume for a metered dose of a liquid;

iv) said chamber having means to release a dose of liquid when said plunger is moved to said second position.

28. An exchangeable container of claim 27 wherein said means for releasing a dose of liquid is provided by said chamber being open ended in a direction forward of said plunger front face, said plunger seal means when moved to said second position extending beyond said chamber open end sufficiently to release a dose of liquid.

29. An exchangeable container for a liquid dishwasher chemical agent and which is adapted for use on a dispenser which is mounted inside of a dishwasher, said container comprising:

(i) a hollow body portion;

(ii) an outlet for said container located at a lowermost portion of said container when said container is in an inverted use position on a dispenser;

(iii) means for metering a dose of liquid dishwasher chemical agent as such liquid would drain through said container outlet in an inverted use position on a dispenser, said metering means being connected to said container outlet and adapted to retain liquid in said container when in an inverted use position on a dispenser;

(iv) said metering means having reciprocal means exterior of said container for engagement by a dispenser for said container whereby movement of said reciprocal means from a first non-dispensing position to a second dispensing position dispenses a metered dose of liquid;

(v) said metering means comprising:

(a) a chamber in communication with said container outlet, said chamber having a cylindrical interior surface;

(b) a plunger for reciprocal movement in said chamber between said first and second positions, said plunger having a front face and a rear face;

(c) means for sealing an outer periphery of said plunger between said front and rear faces with the cylindrical interior surface of the chamber, a portion of said chamber behind said rear face of said plunger when said plunger is in said non-dispensing position defining a volume for a metered dose of said dishwasher chemical agent;

(d) said chamber having means to release a dose of said dishwasher chemical agent when said plunger is moved to said second position;

(e) a cylindrical piston connected to and spaced from said rear face of said plunger, said cylindrical piston contacting said cylindrical interior surface and is located relative to said plunger such that when said plunger is in said second position, said piston is in a position to block flow of liquid from said chamber for releasing such liquid;

(f) said container having a second outlet in communication with said cylindrical chamber and located behind said piston whereby liquid flows from said container into said chamber behind said piston as said plunger is moved to said second position; and (g) said second outlet being dimensioned for a particular viscosity of a liquid to be dispensed to control rate of return of liquid through said second outlet as said plunger is returned to said first position whereby rate of return of said plunger is correspondingly controlled.

* * * * *